US005938375A

United States Patent [19]

Wheeler, Jr. et al.

[11] Patent Number: 5,938,375

[45] Date of Patent: Aug. 17, 1999

[54] METHOD OF SEALING JOINTS BETWEEN ADJACENT SHEET PILING SECTIONS TO FORM A CONTINUOUS BARRIER AND BARRIERS FORMED USING SAID METHOD

[75] Inventors: Mason G. Wheeler, Jr., Jeannette, Pa.; Russell W. Harris, Wilson, N.Y.

[73] Assignee: Sevonson Environmental Services, Inc., Niagara Falls, N.Y.

[21] Appl. No.: 08/992,261

[22] Filed: Dec. 17, 1997

[51] Int. Cl.[6] ..... E02D 5/02; B63B 35/03

[52] U.S. Cl. ..... 405/274; 405/152; 405/153; 405/279; 52/588.1

[58] Field of Search ..... 405/152, 153, 405/274, 275, 276, 277, 278, 279, 280, 281, 71, 72; 277/316, 630, 637, 650, 935, 944; 52/412, 588.1, 592.4

[56] References Cited

U.S. PATENT DOCUMENTS

| | | | |
|---|---|---|---|
| 842,120 | 1/1907 | Skinner | 405/279 |
| 2,880,589 | 4/1959 | Wilson et al. | 405/281 |
| 3,302,412 | 2/1967 | Hunsucker . | |
| 3,439,406 | 4/1969 | Wallin | 277/316 |
| 3,451,696 | 6/1969 | Hagelin et al. | 277/316 |
| 3,492,826 | 2/1970 | Horstketter et al. . | |
| 3,650,553 | 3/1972 | Wennstrom . | |
| 3,688,508 | 9/1972 | Taylor . | |
| 3,688,509 | 9/1972 | Van Weele et al. . | |
| 3,828,563 | 8/1974 | Saucke . | |
| 4,182,087 | 1/1980 | Schall et al. | 405/278 X |
| 4,808,039 | 2/1989 | Fischer | 405/279 X |
| 4,863,315 | 9/1989 | Wickberg . | |
| 4,981,540 | 1/1991 | Prochhorst . | |
| 5,163,785 | 11/1992 | Zanelli et al. . | |
| 5,437,520 | 8/1995 | Cherry et al. . | |
| 5,466,016 | 11/1995 | Briody et al. | 277/178 X |
| 5,520,487 | 5/1996 | Decker | 405/279 X |
| 5,551,808 | 9/1996 | Sandanasamy et al. | 405/279 |
| 5,725,201 | 3/1998 | Parth | 52/588.1 X |
| 5,730,446 | 3/1998 | Taylor et al. | 277/637 X |

FOREIGN PATENT DOCUMENTS

| | | | |
|---|---|---|---|
| 131711 | 10/1981 | Japan | 405/279 |
| 401280122 | 11/1989 | Japan | 405/274 |
| 2228760 | 9/1990 | United Kingdom . | |

*Primary Examiner*—David J. Bagnell
*Assistant Examiner*—Jong-Suk Lee
*Attorney, Agent, or Firm*—Kevin E. McDermott

[57] ABSTRACT

A method and device for sealing the joint formed by the connection of adjacent sheet piling sections. Prior to installation in the ground, a housing having an open side is attached near the edge of a sheet piling section. A barrier is inserted between the open side of the housing and the sheet piling section and a sealant material is added to the housing. After the sheet piling section and the attached housing are installed in the ground, the barrier is removed and the sealant material contacts the joint to form a watertight seal.

38 Claims, 5 Drawing Sheets

Fig. 7
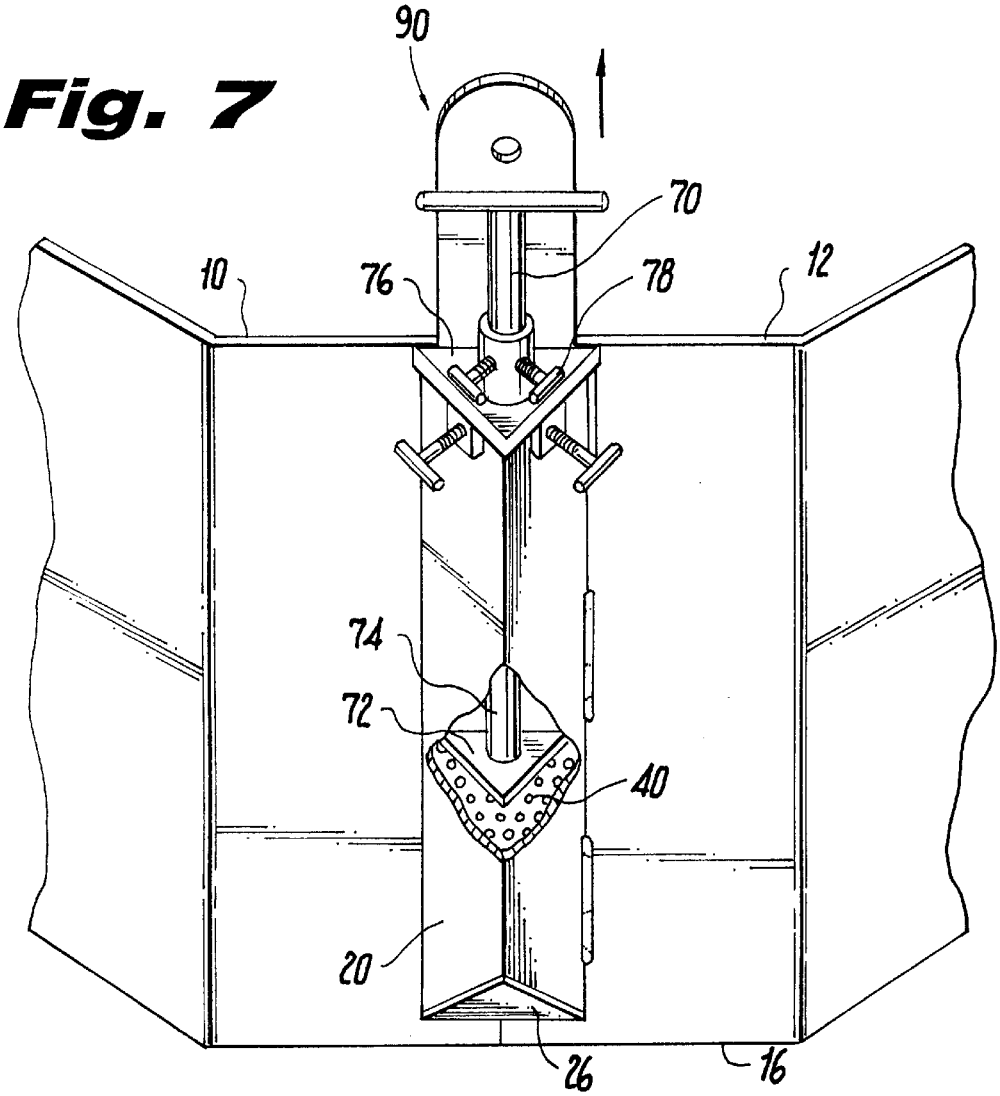
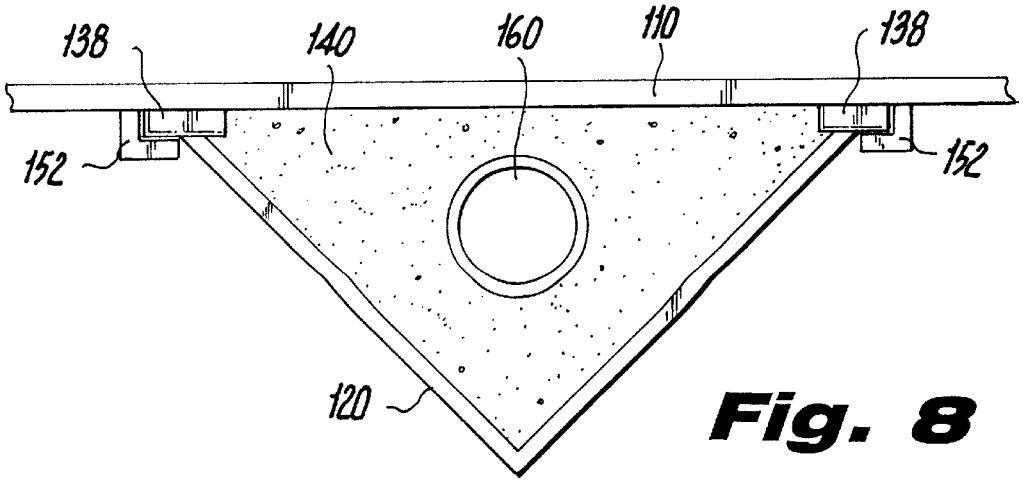
Fig. 8

METHOD OF SEALING JOINTS BETWEEN ADJACENT SHEET PILING SECTIONS TO FORM A CONTINUOUS BARRIER AND BARRIERS FORMED USING SAID METHOD

FIELD OF THE INVENTION

The present application relates to in-ground barriers comprising sections of sheet piling driven into the ground to form a wall, cofferdam or the like. In particular, the present invention relates to watertight connecting joints between adjacent sections of in-ground sheet piling that form a continuous barrier which restricts the migration of groundwater and other liquids.

BACKGROUND OF THE INVENTION

Interlocking sections of sheet piling driven into the ground is a popular, cost-effective method for installing barrier walls to prevent the movement of soils and limit groundwater migration. Typical sheet piling sections are made of steel plates and have connectors on the side edges. The sheet piling sections are installed sequentially by interlocking the connectors of adjoining sheet piling sections to form a continuous barrier. However, standard sheet piling barriers are not watertight since the interlocking joints provide a potential flow path for the passage of groundwater and other liquids. Attempts have been made to seal the joints between sections of sheet piling but these attempts have been difficult and expensive to implement and have not always provided a watertight seal.

Previously known methods for forming watertight seals between interlocking sheet piling sections use interlocking mechanisms that form cavities when connected to the adjoining section. After the sheet piling sections are driven into the ground, soil, vegetation and other materials that accumulate in the cavities when the sheet piling sections are driven into the ground are removed and the cavities are then filled with a sealant to form a watertight barrier. These methods encounter several problems that make it time consuming and expensive to form a satisfactory watertight seal. Before the cavities can be filled with a sealant, the materials accumulated in the cavities have to be removed using time consuming and labor intensive methods. However., once the barriers are installed in the ground, it is difficult to insure that all of the materials have been removed from the cavities. If any materials are left in a cavity, the sealant may not completely fill the cavity when it is added and a potential flow path is created for groundwater to pass through the barrier.

Several patents describe specially constructed sheet piling sections with interlocking joints which form a cavity that is filled with a sealing material. U.S. Pat. No. 3,302,412 to Hunsucker discloses interlocking thumb and finger elements which form a cavity between adjacent sheet piling sections that is filled with a sealant. U.S. Pat. No. 5,163,785 to Zanelli et al. employ an interlocking sheet piling mechanism shaped like claws that form a cavity for sealant material. U.S. Pat. No. 5,437,520 to Cherry et al. teach joints between pile-driven sheet piles having edge forms which interlock to form two cavities that are filled with a sealant.

Certain other types of prior constructions have been tried, but these constructions have required the cavities to be cleaned out after the sheet piling sections are installed before the sealant material is added. Thus, all prior constructions have the inherent disadvantages common to those above denoted relative to materials accumulated in the cavities formed by the interlocking joints when the sheet piling sections are installed.

Another disadvantage of previously known methods is inherent in the fact that they require specially fabricated sheet piles and cannot use standard sheet piles. Also, the interlocking joints of these specially fabricated sheet piles are easily damaged when installed in the ground, either making it difficult to fill the cavities with the sealant or preventing the joint from being properly sealed. An additional disadvantage specially fabricated sheet piles used in previously known methods is that they cannot easily be disassembled and reused because the interlocking connectors are damaged when the sheet piling sections are removed from the ground.

SUMMARY OF THE INVENTION

The present invention discloses a method of sealing the joints between sections of standard sheet piling to provide a continuous barrier to the migration of groundwater. This method can also be used to seal the joints between non-standard sheet piling sections. Sheet piling sections covered by the present invention include: sheet piling sections made of steel, iron, aluminum, or alloyed metals, double wall sheet piling sections, and preformed sheet piling sections made of cement, concrete, and composite materials.

Sheet piling sections are typically installed by sequentially driving individual sections of sheet piling into the ground. Sheet piling sections are connected to adjacent sheet piling sections by means of interlocking joints on the abutting side edges of the sheet piling sections. The joints so formed are not watertight and barriers formed by these sheet piling sections do not prevent the migration of groundwater. It has been discovered that a watertight seal can be formed by attaching a housing containing a sealant material to a sheet piling section prior to installation.

By various aspects of this invention, one or more of the following or other objectives can be obtained.

It is am object of this invention to provide a method of sealing the joints between sheet piling sections that can be easily and economically implemented with readily available materials. The method uses standard sheet piling sections and sealing materials to form an impermeable seal.

It is a further object of this invention to provide a method for sealing sheet piling sections that can be used with standard sheet piling sections or that can be incorporated into the design of sheet piling sections when they are manufactured.

It is still a further object of this invention to provide a method for sealing sheet piling sections that does not damage the connecting edges of the sheet piling when the sheet piling is removed so that the sheet piling sections can be easily reused.

Another object of this invention is to provide a method for sealing the joints between sheet piling sections with damaged connecting edges that do not tightly interlock with the adjoining sheet piling sections.

A further object of this invention is to provide a method for forming a casing for a test well on either one or both sides of a sheet piling section.

Other aspects, objects, and the several advantages of this invention are apparent to one skilled in the art from a study of this disclosure, the drawings, and the appended claims.

According to the present invention, a housing comprising a removable barrier and containing a sealant material is attached to a sheet piling section parallel to and overlapping the connecting edge prior to installation. After the sheet piling section is installed, the barrier is removed and the sealant material contacts the interlocking joint and the adjacent sheet piling sections to form a watertight seal.

In one embodiment of the invention, a "hydroswellable" sealant material is used, preferably bentonite. The liquid reagent is preferably added to the "hydroswellable" sealant material after the housing is attached to the sheet piling section and prior to installation. However, the sealant material can also be hydrated by means of a perforated tube or pipe positioned along the longitudinal axis of the housing after the housing and sheet piling section are installed in the ground and the barrier is removed. The liquid reacts with the sealant material to increase the volume and insure a tight seal around the joint. In another embodiment, a polyurethane foam is injected into the housing under pressure and subsequently solidifies to form a watertight seal. In still another embodiment, a metal tube is placed in the housing extending along its longitudinal axis and plastic, rubber, silicone or other synthetic material in the form of resins or pellets is packed into the housing around the tube. After the sheet piling section and the attached housing have been installed in the ground, the barrier is removed and a heating element is inserted into the tube to heat the sealant material to a temperature above its melting point. After the sealant material has melted, the heating element is withdrawn from the tube and the sealant material solidifies to form a watertight seal.

BRIEF DESCRIPTION OF THE DRAWINGS

In the drawings:

FIG. 7 is an oblique view of a packing assembly mounted on a housing attached to an installed sheet piling section prior to the withdrawal of the barrier.

FIG. 8 is a plan view of a housing and a monitoring well mounted on the side wall of a sheet piling section.

DESCRIPTION OF THE PREFERRED EMBODIMENT

Figure 1:
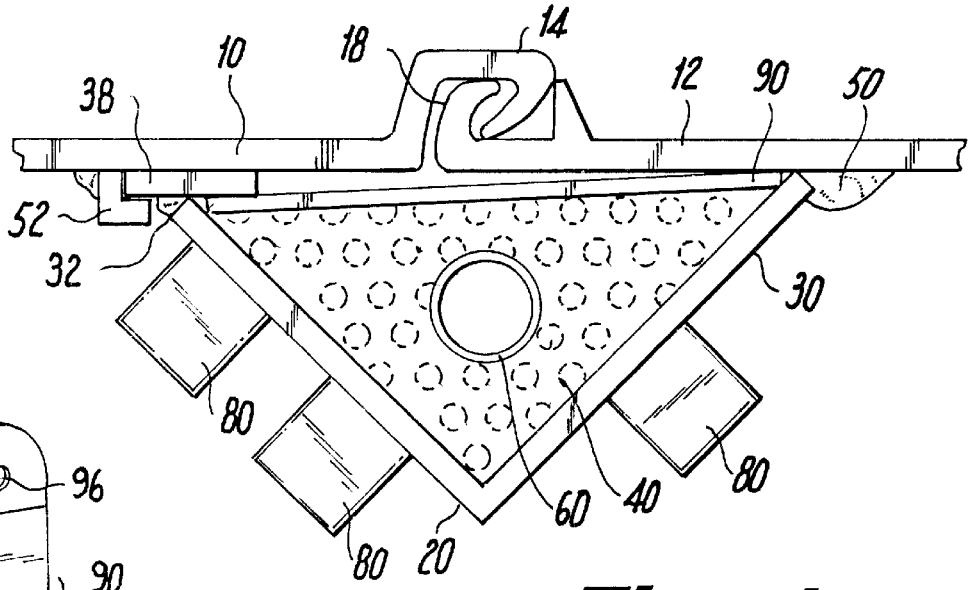
FIG. 1 is a plan view of an installed sealant apparatus showing the interlocking joint formed by two sheet piling sections, the housing, the barrier and the sealant material.

Referring to the accompanying drawings, FIGS. 1 through 5 show a preferred embodiment of the present invention. According to the present invention, the interlocking joint 14 formed by two adjacent sheet piling sections 10 and 12 is sealed by attaching a housing 20 filled with a sealant material 40 along the edge of one of the sheet piling sections 12 prior to installing the section in the ground. The housing 20 extends beyond the edge 18 of the sheet piling section 12 so that when the sheet piling section 12 is installed, the housing 20 overlaps the interlocking joint 1z and the adjacent sheet piling section 10. The housing 20 has an opening 28 along its length on the side facing the interlocking joint 14, The opening 28 is defined by the inside edge 30 and the outside edge 32 of the housing 20. The housing 20 is attached to the sheet piling section 12 along its inside edge 30 and its outside edge 32 extends beyond the interlocking joint 14. The housing 20 has an interior wall 34 that contacts the sealant material 40 and an exterior wall 36 that contacts the ground or other material into which the sheet piling section 12 is installed.

The housing 20 has a top end 22 and a bottom end 24. When the housing 20 is attached to the sheet piling section 12 and installed in the ground, the bottom end 24 of the housing 20 is located above the bottom edge 16 of the sheet piling section 12 and the top end 22 of the housing 20 is located at a point above the level of the ground. The top end 22 of the housing 20 is open and the bottom end 24 of the housing 20 is closed. The bottom end 24 of the housing 20 slopes downwardly toward the sheet piling section 12 to allow the housing 20 to more easily penetrate the ground.

Figure 3:
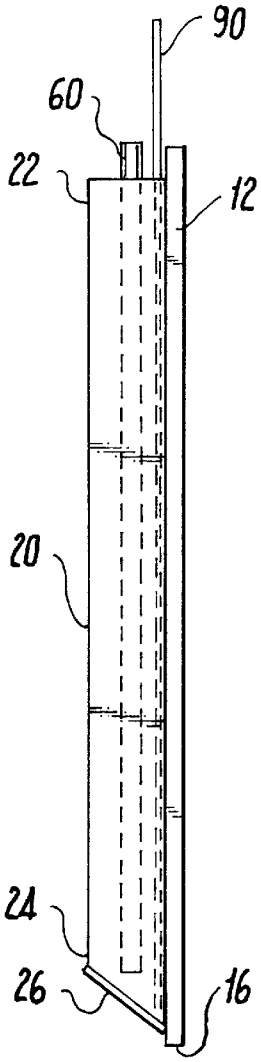
FIG. 3 is a side elevation of a housing, a tube, a barrier and a sheet piling section.
Figure 5:
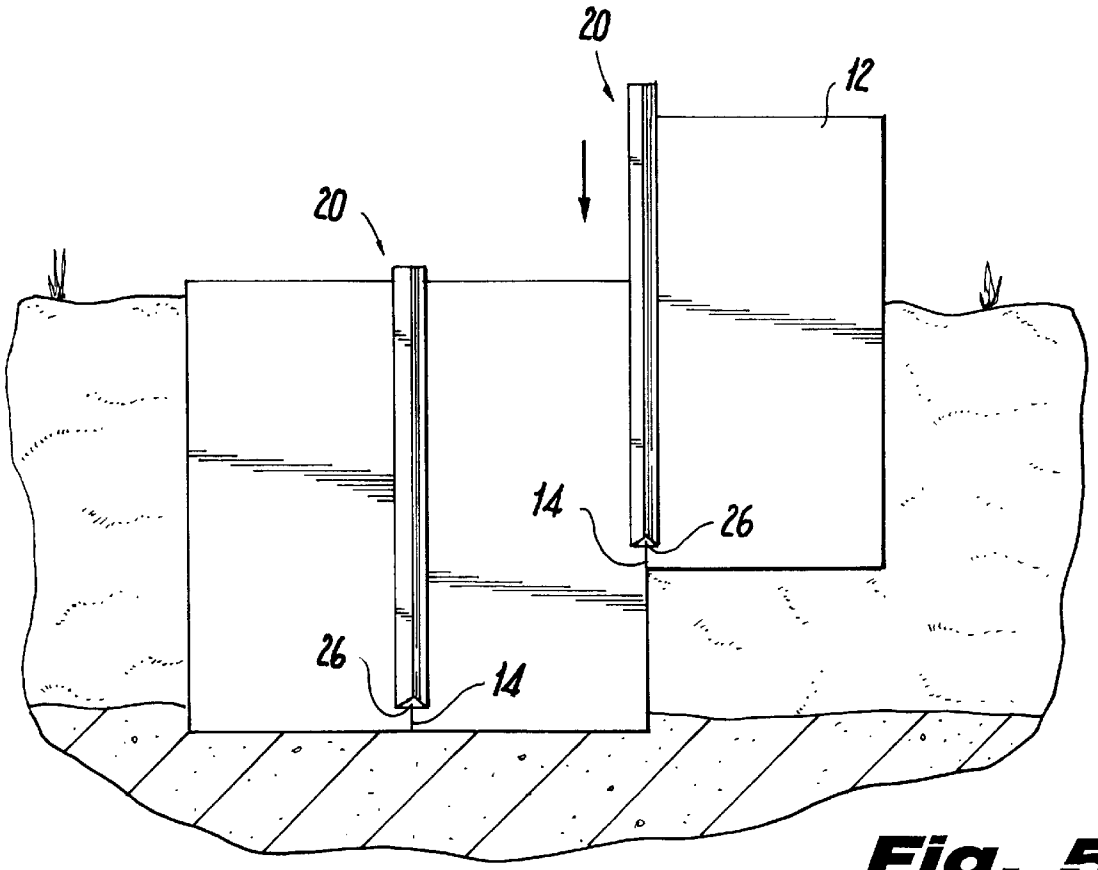
FIG. 5 is a side elevation of a series of sheet piling sections that are being installed to form a continuous wall.

The housing 20 can be made from a variety of materials and can have a variety of configurations. The housing 20 can be formed from angle iron, angle steel, L-shaped or U-shaped lengths of metal, concave iron or steel, or half-pipe sections (sections of pipe cut in half along their longitudinal axis). Angle steel is the preferred construction but other lengths of metal having a cavity along their longitudinal axis can be used. The half section of pipe is made of iron, steel, aluminum or other metal or it can be made of concrete, cement, plastic or other synthetic or composite materials. In a preferred embodiment, the housing 20 is formed from a section of angle steel with the bottom end 24 formed so that when the housing 20 is attached to the sheet piling section 12, the bottom end 24 slopes inwardly and downwardly from the angle toward the sheet piling section 12. The bottom end 24 of the housing 20 is sealed by attaching a bottom plate 26, as shown in FIG. 3.

The housing 20 is attached to the sheet piling section 12 by various well-known methods. The preferred method is to weld the housing 20 to the sheet piling section 12 either by continuous or intermittent welds 50. The housing 20 can also be bolted to the sheet piling section 12 or mechanically fastened. Depending on the type of sealant material 40 that is used, the walls of the housing 20 can be solid or can have perforations.

The housing 20 is filled with a sealant material 40 before the sheet piling section 12 is installed to insure that the sealant material 40 completely fills the housing 20. A barrier 90 is installed across the opening 28 in the housing 20 to prevent the sealant 40 from leaking out of the housing 20 when the sheet piling section 12 is installed. In the preferred embodiment, the barrier 90 is removed after the sheet piling section 12 is installed. However, the present invention also includes embodiments in which the barrier 90 is formed of a permeable material that remains in place after the sheet piling section 12 is installed. The permeable material is a perforated material, such as a metal screen, or a permeable cloth or plastic material. After the sheet piling section 12 is installed, the sealant material 40 passes through the permeable material and contacts the interlocking joint 14 and the sheet piling sections 10 and 12.

Figure 2:
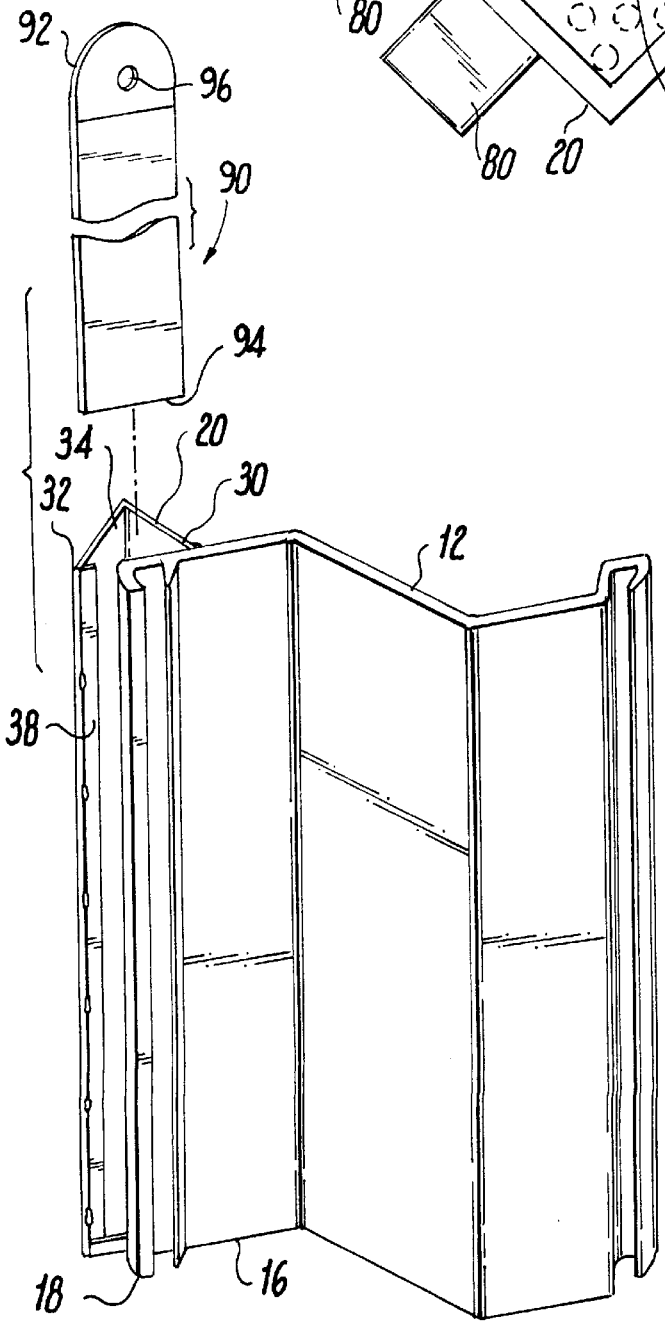
FIG. 2 is an oblique view of a barrier as it is being inserted between a housing and a sheet piling section prior to installation in the ground.
Figure 4:
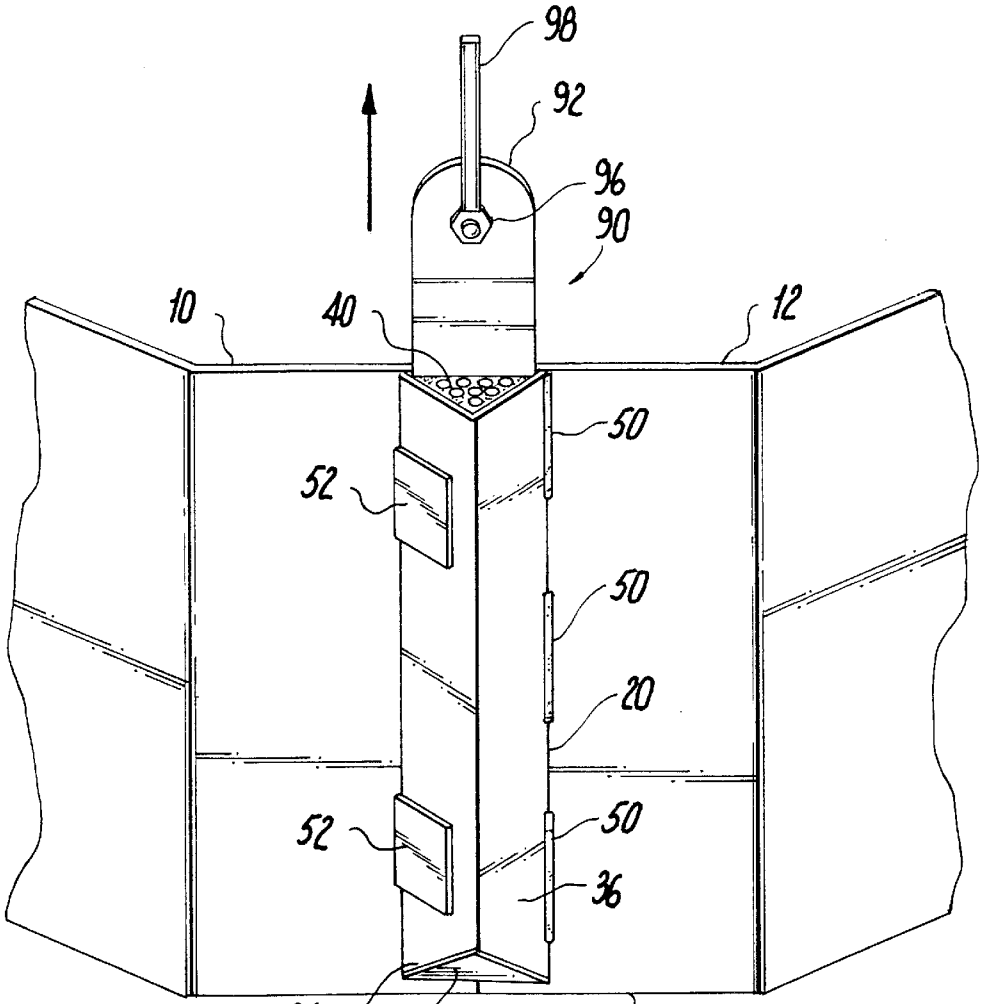
FIG. 4 is an oblique view of a housing attached to an installed sheet piling section prior to the withdrawal of the barrier.

FIGS. 2 and 4 show how the barrier 90 functions. FIG. 2 shows the barrier 90 as it is being installed across the opening 28 of the housing 20. FIG. 4 shows the barrier 90 confining the sealant material 40 inside the housing 20 after the sheet piling section 12 is installed in the ground. The barrier 90 has a top end 92 that extends above the top end 22 of the housing 20 and a bottom end 94 which extends to the bottom end 24 of the housing 20. The barrier 90 is installed after the housing 20 is attached to the sheet piling section 12. The sealant material 40 is added either before or after the barrier 90 is installed, depending on the type of sealant material 40 that is used. After the sealant material 40 is added to the housing 20, the sheet piling section 12 is installed and the barrier 90 is removed. A means is provided at the top end 92 of the barrier 90 for attaching a lifting device 96 to the barrier 90 for removing the barrier 90 from between the housing 20 and the sheet piling section 12. In one of the preferred embodiments, a shackle 98 is attached to the barrier 90 and the shackle 98 is then connected to a crane or a similar lifting device.

The barrier 90 is a flat sheet of material constructed with sufficient thickness and strength to retain its shape and structural integrity after multiple uses. The barrier 90 is made of steel, aluminum or plastic and in some embodiments the barrier 90 has a non-stick coating applied to the surfaces, The non-stick coating prevents the sealant material 40 from adhering to the barrier 90 and facilitates the withdrawal of the barrier 90 from the housing 20. A preferred embodiment of the barrier 90 is constructed of stainless steel and has a Teflon coating. In another preferred embodiment, a screen or permeable material is installed between the barrier 90 and sealant material 40 to prevent the sealant material 40 from sticking to the barrier 90. The screen is made of metal or plastic with the mesh size selected based on the type of sealant material 40 that is used. The preferred permeable material is either gauze or cheesecloth.

FIG. 2 shows how the barrier 90 is slidably positioned between the inside edge 30 of the housing 20 and the sheet piling section 12 on one side and a receiving means 38 and the interior wall 34 of the housing 20 on the other side. The receiving means 38 secures the barrier 90 in place across the opening 28 of the housing 20 when the sheet piling section 12 and housing 20 are installed in the ground and permits the easy withdrawal of the barrier 90 after the sheet piling section 12 is installed. In a preferred embodiment, a receiving means 38 is attached to the outside edge 32 of the housing 20 for slidably receiving the barrier 90 in the housing 20. In a most preferred embodiment, the receiving means 38 is formed by attaching a steel plate along the outside edge 32 of the housing 20 for slidably receiving the barrier 90 in the housing 20. In another preferred ermbodiment, the receiving means 38 consists of a slot.

After the sheet piling section 12 and the attached housing 20 have been installed in the ground, the barrier 90 is removed and the sealant material 40 contacts the interlocking joint 14 and the sheet piling sections 10 and 12. In the embodiments where either a hydroswellable sealant material, a chemically reacted sealant material or a thermally reacted sealant material is used, the barrier 90 is removed before the sealant material 40 solidifies.

FIGS. 1 and 4 show a receiving means 52 which guides the sheet piling section 12 and housing 20 into place. One or more of the receiving means 52 are located on the adjoining sheet piling section 10 and slidably receive the housing 20 as the sheet piling section 12 and the attached housing 20 are driven into the ground. The receiving means 52 are curved or angularly disposed so as to engage the housing 20 and direct it toward the sheet piling section 10 as the sheet piling section 12 and the housing 20 are driven into the ground. FIG. 1 shows a preferred embodiment, wherein the barrier receiving means 38 slidably engages the receiving means 52.

Figure 6:
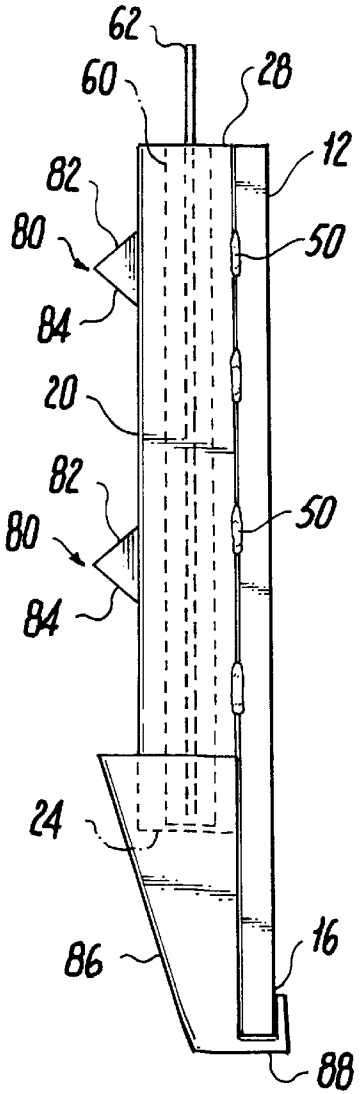
FIG. 6 is a side elevation of a housing formed from a half pipe section and shows a boot and wedges.

FIG. 6 shows an embodiment wherein a plurality of wedges 80 are located at intervals along the length of the housing 20. Each wedge 80 has a top end 82 corresponding to the top end 22 of the housing 20 and a bottom end 84 corresponding to the bottom end 24 of the housing. The wedges 80 have a triangular shape so that the two sides of the wedge 80 opposite the surface of the housing 20 slope from the center toward the top and bottom ends 82 and 84. The triangular shape allows the wedge 80 to penetrate the ground more easily when the sheet piling section 12 is installed, while also allowing the sheet piling section 12 to be easily removed. When the housing 20 and the sheet piling section 12 are driven into the ground, the wedges 80 force the housing 20 toward the sheet piling sections 10 and 12 and the interlocking joint 14 and insure a watertight seal.

FIG. 6 shows a preferred embodiment, wherein the housing 20 is fabricated from a half section of pipe and a metal boot 86 is attached to the bottom end 24 of the housing 20 to absorb the force as the sheet piling section 12 is driven into the ground. The metal boot 86 is most useful when the sheet piling section 12 is being installed in hard ground or when the housing 20 is constructed of a thin walled metal, cement, plastic or a synthetic material. The metal boot 86 has a slotted bottom end 88 which attaches to the bottom edge 16 of the sheet piling section 12 to secure the metal boot 86 to the sheet piling section 12. When secured to the sheet piling section 12, the metal boot 86 extends upwardly and outwardly from the bottom edge 16 of the sheet piling section 12 and encloses the bottom end 24 of the housing 20. As the sheet piling section 12 is driven into the ground, the metal boot 86 directs the soil and other materials away from the wall of the sheet piling section 12 and the housing 20. The preferred material of construction of the metal boot 86 is steel. In a preferred embodiment, the metal boot 86 is secured to the sheet piling section 12 at the slotted bottom end 88. In another embodiment, the boot 86 is not provided with a slotted end 88 and the metal boot 86 is either welded or bolted to the sheet piling section 12.

The sealant material 40 is selected from any of the hydrostatic sealing materials known to those skilled in the art, such as silicon, epoxies, rubbers, plastics and clays. Preferred sealant materials are "hydroswellable" materials, i.e., materials which increase in volume when contacted with a liquid to form an impermeable barrier, and the most preferred "hydroswellable" sealant material is bentonite. Other preferred materials are those which are applied in a flowable state and subsequently harden to form a watertight sealant material 40. The most preferred flowable sealants are polyurethane foams, which are injected into the housing 20 under pressure. Similar synthetic, non-aqueous materials that increase in volume as the result of a chemical reaction to form impermeable barriers may also be used.

When a "hydroswellable" material is used as a sealant material 40, the material can be hydrated before or after the sheet piling section 12 is installed in the ground. "Hydroswellable" materials such as bentonite require up to several hours to fully hydrate after water is added. This allows time for the housing 20 to be installed before the sealant material 40 is completely hydrated. In a preferred embodiment, the sealant material 40 is hydrated immediately before the housing 20 and sheet piling section 12 are installed in the ground.

A preferred embodiment uses materials having a low melting temperature, such as plastic, rubber, silicone or other synthetic material as a sealant material 40. In a most preferred embodiment, these materials are in the form of resins or pellets. These low melting temperature materials are placed in the housing 20 before the sheet piling section 12 is installed. After the sheet piling section 12 and the attached housing 20 are installed in the ground, the barrier 90 is removed and a heating means 62 is used to heat the sealant material 40 to a temperature above its melting point. After the sealant material 40 has melted, the heating means 62 is removed and the sealant material 40 solidifies to form a watertight seal. In a preferred embodiment, the heating means 62 is an electrical heating element that extends the length of the housing 20.

FIG. 6 shows an embodiment of the invention wherein a tube 60 is inserted in the housing 20 along its longitudinal axis and extending from the bottom end 24 of the housing 20 to above the top end 22 of the housing 20. After the tube 60 is inserted in the housing 20, the sealant material 40 is added to the housing 20 and packed around the tube 60 to secure the tube 60 in place. When a hydroswellable sealant material or a chemically activated sealant material is used, a preferred embodiment of the invention uses a perforated tube 60, which provides a means for water or chemical reagent to contact the sealant material 40. A solid walled tube 60 is preferred when an electrical heating element is inserted into the tube 60 to melt the sealant material 40 and form a watertight seal.

The tube 60 is made from materials well known to those skilled in the art, including steel, aluninum and plastic. The material of construction and the diameter and wall thickness of the tube 60 are selected based on the size of the housing 20 and the sealant material 40 that is used. In one embodiment, a pipe is used instead of a tube.

FIG. 7 shows a packing apparatus 70 that is used to compress the sealant material 40 inside the housing 20 and to prevent the sealant material 40 from escaping from the housing. When a "htydroswellable" sealant material is hydrated after the sheet piling section 12 and housing 20 are installed, the packing apparatus 70 forces the sealant material 40 toward the interlocking joint 14 and the walls of the sheet piling sections 10 and 12 and prevents the sealant material 40 from flowing out through the top end 22 of the housing 20.

The packing apparatus 70 comprises a plate 72 sized to fit within the perimeter formed by the interior wall 34 of the housing 20 and the barrier 90 with sufficient clearance to allow the plate 72 to slidably move upwardly and downwardly inside the housing 20 while at the same time preventing the sealant material 40 from escaping from the housing 20. The plate 72 is attached to a shaft 74 which extends upwardly from the top of the plate 72 to above the top end 22 of the housing 20. The shaft 74 is used to move the plate 72 downwardly in the housing 20 to compress the sealant material 40.

In a preferred embodiment, the packing assembly 70 comprises a locking assembly 76 which is secured to the top end 22 of the housing 20. The locking assembly 76 has an aperture through which the shaft 74 passes and a locking means 78 to secure the shaft 74 in place. The packing assembly 715 is constructed so that it does not interfere with the barrier 90 when the barrier 90 is withdrawn from the housing. When a tube 60 is installed in the housing 20, the plate 72 has an aperture in it and the shaft 74 is hollow so that the tube 60 passes through the plate 72 and the shaft 74 and does not interfere with the packing apparatus 70.

Standard sheet piling sections are available in different widths and lengths. However, it is frequently necessary to construct a sheet piling wall to a depth that exceeds the lengths of standard sections. In such cases, the top edge of a first sheet piling section is connected to the bottom edge of a second sheet piling section by welding the sections together. After the sheet piling sections are thus connected, the housing 20 of the present invention is fabricated to the required length.

It has also been found that the housings and the techniques described above for attaching the housings to sheet piling sections can be used as an inexpensive method for forming casings for test and monitoring wells. After sheet piling barriers are installed to prevent the migration of groundwater containing contaminants, it is often necessary to monitor the groundwater on either one or both sides of the barrier. Previously, test wells were independently installed after the barrier was in place. By using the housing to form the well casing, the test well casings can be installed when the sheet piling sections are installed.

Figure 9:
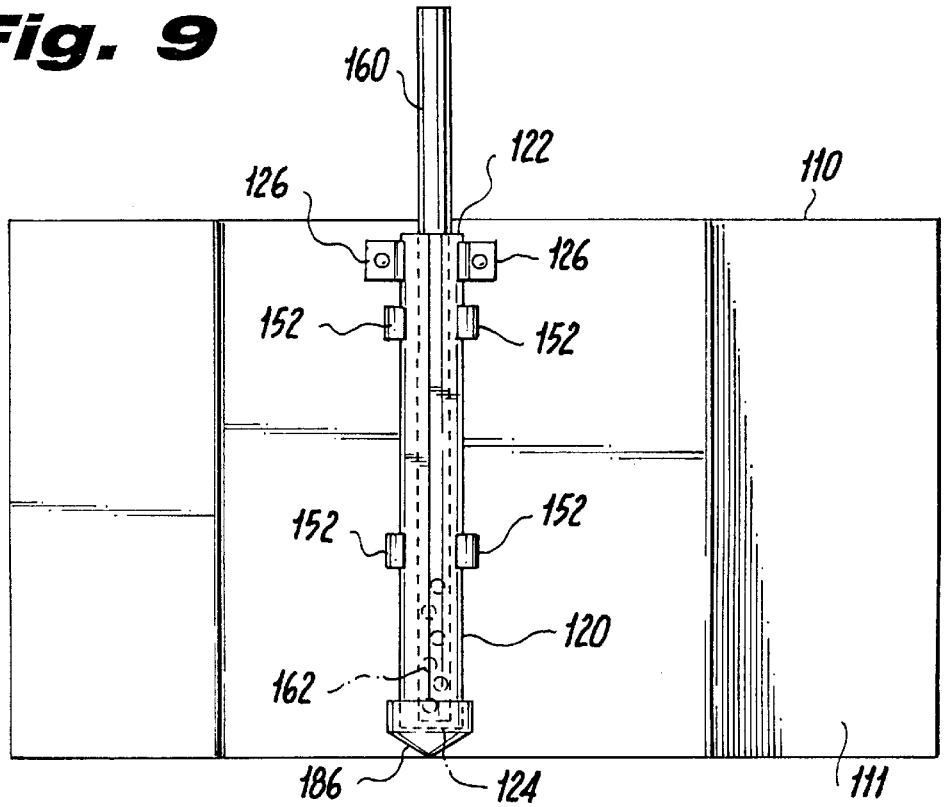
FIG. 9 is a side elevation of a housing, a monitoring well, a boot and a sheet piling section before the sheet piling section is installed in the ground.
Figure 10:
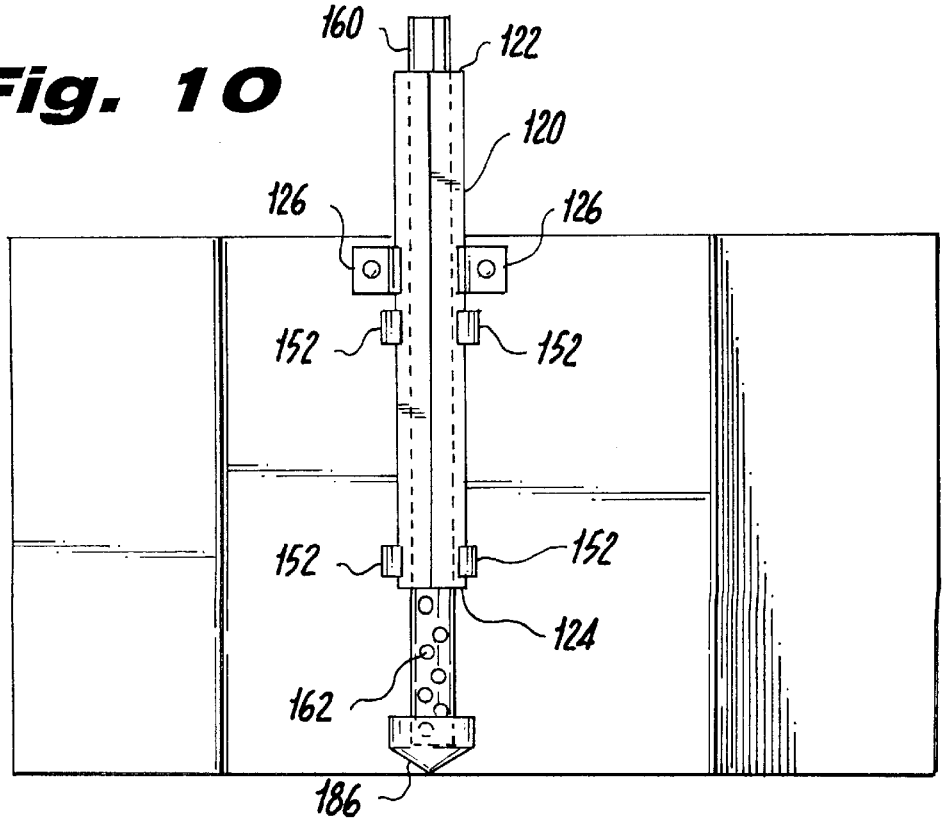
FIG. 10 is a side elevation of a housing, a monitoring well, a boot and a sheet piling section after the sheet piling section has been installed in the ground.

FIGS. 8, 9 and 10 show a housing 120 slidably attached to the side wall 111 of a sheet piling section 110. The housing 120 comprises an open top end 122, a closed bottom end 124 and a means for slidably attaching 138 the housing 120 to the sheet piling section 110. A plurality of receiving means 152 are attached to the side wall 111 of the sheet piling section 110 for slidably receiving the housing 120. A boot 186 which encloses the bottom end 124 of the housing 120 is attached near the bottom of the sheet piling section 110 to prevent soil and other materials from entering the housing 120 when the sheet piling section 110 is installed. Prior to installation of the sheet piling section 110, the receiving means 152 are attached to the sheet piling section 110 and the housing 120 is slidably inserted in the receiving means 152. The housing 120 is secured in place by fastening means 126 which prevent the housing 120 from moving when the sheet piling section 110 is installed. The construction of the housing 120 and the installation methods are similar to those described above for sealing the joints between sheet piling sections. FIG. 9 shows the configuration of the housing 120 when the sheet piling section 110 is being installed.

After the sheet piling section 110 is installed in the ground, a monitoring well is inserted into the housing 120. The monitoring well is well known to one skilled in the art and it typically comprises a length of PVC pipe 160 with the lower portion perforated to allow groundwater to enter the pipe. The space between the housing 120 and the monitoring well 160 is then filled with a packing material 140, such as sand, which permits the free passage of groundwater. The housing 120 is then withdrawn to a point above the perforations 162 in the pipe 160 and secured in place by the fastening means 126. FIG. 10 shows the monitoring well as it samples the surrounding groundwater.

In the foregoing description, certain terms have been used for brevity, clarity and understanding, but no unnecessary limitations are to be implied therefrom beyond the requirements of the prior art, because such words are used for descriptive purposes herein and are intended to be broadly construed. Moreover, the embodiments of the improved construction illustrated and described herein are by way of example, and the scope of the invention is not limited to the exact details of construction.

Having now described the invention, the construction, the operation and use of preferred embodiments thereof, and the advantageous new and useful results obtained thereby, the new and useful construction, and reasonable mechanical equivalents thereof obvious to those skilled in the art, are set forth in the appended claims.

What we claim is:

1. A method of sealing a connection between a first sheet piling section and a second sheet piling section, wherein said second sheet piling section comprises a first side edge which connects to said first sheet piling section to form an interlocking joint, and wherein said method comprises:

installing said first sheet piling section in the ground;

attaching a housing comprising an interior wall, an exterior wall, an open top end, a closed bottom end and an open side to said second sheet piling section, wherein said housing extends beyond said first side edge of said second sheet piling section;

placing a barrier between said open side of said housing and said second sheet piling section;

adding a sealant material to said housing;

installing said second sheet piling section and said housing in the ground; and removing said barrier;

wherein said sealant material contacts said first and second sheet piling sections and said interlocking joint to form a seal between said first and second sheet piling sections.

2. The method according to claim 1, wherein said closed bottom end of said housing slopes downwardly.

3. The method according to claim 1, wherein said method comprises the additional step of in stalling a tube in said housing.

4. The method according to claim 1, wherein said sealant material is bentonite.

5. The method according to claim 1, wherein said sealant material is a polyurethane.

6. The method according to claim 1, wherein said method further comprises the step of heating said sealant material.

7. The method according to claim 1, wherein said barrier is a steel plate comprising a top end and a bottom end and a lifting means on said top end.

8. The method according to claim 1, wherein said housing further comprises a means for slidably receiving said barrier.

9. The method according to claim 1, wherein said first sheet piling section comprises a means for slidably receiving said housing.

10. The method according to claim 1, wherein said housing further comprises a plurality of wedges attached to said exterior wall of said housing.

11. The method according to claim 1, wherein said method further comprises the step of attaching a boot to said second sheet piling section, wherein said boot encloses said bottom of said housing.

12. The method according to claim 1, wherein said method comprises the additional step of attaching a means for compressing said sealant material to said top end of said housing.

13. The method according to claim 12, wherein said means for compressing said sealant material comprises a plate for enclosing said top open end of said housing.

14. A method of sealing a connection between a first sheet piling section and a second sheet piling section, wherein said second sheet piling section comprises a first side edge which connects to said first sheet piling section to form an interlocking joint, and wherein said method comprises:

installing said first sheet piling section in the ground;

attaching; a length of angle steel to said second sheet piling section, wherein said angle steel comprises an open top end, a closed bottom end, a first wall, a second wall and an angle formed by said first and second walls, wherein said first and second walls extend outwardly from said angle to a first edge and a second edge respectively, and wherein said first edge of said angle steel is attached to said second sheet piling section and said second edge extends beyond said first side edge of said second sheet piling section, placing at barrier between said angle steel and said second sheet piling section, wherein said barrier, said closed bottom end and said first and second walls form a cavity;

adding a sealant material to said cavity;

installing said second sheet piling section and said angle steel in the ground; and removing said barrier;

wherein said sealant material contacts said first and second sheet piling sections and said interlocking joint to form a seal between said first and second sheet piling sections.

15. The method according to claim 14, wherein said closed bottom end of said angle steel slopes downwardly from said angle to said first and second edges.

16. The method according to claim 14, wherein said method comprises the additional step of installing a tube in said cavity.

17. The method according to claim 14, wherein said sealant material is bentonite.

18. The method according to claim 14, wherein said barrier is a steel plate comprising a top end and a bottom end and a lifting means on said top end.

19. The method according to claim 14, wherein said first sheet piling section comprises a means for slidably receiving said angle steel.

20. A method of sealing a connection between a first sheet piling section and a second sheet piling section, wherein said second sheet piling section comprises a first side edge which connects to said first sheet piling section to form an interlocking joint, and wherein said method comprises:

installing said first sheet piling section in the ground;

attaching a half pipe section to said second sheet piling section, wherein said half pipe section comprises a first longitudinal side edge, a second longitudinal side edge, an open side, an open top end and a closed bottom end, and wherein said first longitudinal side edge of said half pipe section is attached to said second sheet piling section and said second longitudinal side edge extends beyond said first side edge of said second sheet piling section;

placing a barrier between said open side and said second sheet piling section to form a cavity;

adding a sealant material to said cavity;

installing said second sheet piling section and said half pipe section in the ground; and removing said barrier;

wherein said sealant material contacts said first and second sheet piling sections and said interlocking joint to form a seal between said first and second sheet piling sections.

21. The method according to claim 20, wherein said method comprises the additional step of installing a tube in said enclosed space.

22. The method according to claim 20, wherein said sealant material is bentonite.

23. The method according to claim 20, wherein said barrier is a steel plate comprising a top end and a bottom end and a lifting means on said top end.

24. The method according to claim 20, wherein said first sheet piling section comprises a means for slidably receiving said half pipe section.

25. A continuous in-ground barrier comprising a plurality of sheet piling sections, wherein a first sheet piling section and a second sheet piling section comprising a first side edge are connected to form an interlocking joint and said joint is sealed by a device comprising:

a housing comprising a top end, a closed bottom end and an open side, wherein said housing is attached to said second sheet piling section and extends beyond said first side edge;

a barrier inserted between said open side of said housing and said second sheet piling section to form a cavity; and a sealant material added to said cavity;

wherein after said first sheet piling section is installed in the ground, said second sheet piling section and attached housing are installed, said barrier is removed and said sealant material contacts said interlocking joint.

26. The device according to claim 25, wherein said closed bottom end of said housing is angularly disposed.

27. The device according to claim 25, wherein said housing further comprises a means for slidably receiving said barrier.

28. The device according to claim 25, wherein said housing further comprises a plurality of wedges for directing said housing toward said first sheet piling section.

29. The device according to claim 25, wherein said housing further comprises a means for compressing said sealant material in said cavity.

30. The device according to claim 25, wherein said housing further comprises a bottom end and a tube extending upwardly from said bottom end.

31. The device according to claim 25, wherein said first sheet piling section comprises a means for slidably receiving said housing.

32. The device according to claim 25, wherein said barrier further comprises a lifting means.

33. The device according to claim 25, wherein said device further comprises a boot attached to said second sheet piling section and said boot encloses said bottom end of said housing.

34. The device according to claim 25, wherein said sealant material is bentonite.

35. The device according to claim 25, wherein said sealant material is a polyurethane.

36. The device according to claim 25, wherein said sealant material is heated after said second sheet piling section and said housing are installed.

37. A continuous in-ground barrier comprising a plurality of sheet piling sections, wherein adjacent sheet piling sections are connected to form an interlocking joint, and wherein said interlocking joint is sealed by a device comprising:

a housing comprising a top end, a closed bottom end and an open side, wherein said closed bottom end slopes downwardly and said housing is attached to a sheet piling section and extends beyond said interlocking joint;

a barrier slidably inserted between said open side of said housing and said sheet piling section; and a sealant material added to said housing;

wherein said sheet piling section is installed in the ground, said barrier is removed and said sealant material contacts said interlocking joint.

38. A device for sealing an interlocking joint formed by a first sheet piling section and a second sheet piling section, wherein said device comprises:

a housing comprising a first side edge and a second side edge, wherein said side edges define an open side;

a removable barrier between said open side of said housing and said sheet piling section; and a sealant material added to said housing;

wherein when said first and second sheet piling sections are installed, said first side edge is attached to said first: sheet piling section and said second side edge is juxtaposed with said second sheet piling section and said sealant material contacts said interlocking joint when said barrier is removed.

* * * * *